United States Patent [19]

McElroy

[11] 4,410,308

[45] Oct. 18, 1983

[54] COMBUSTION FURNACE AND BURNER

[76] Inventor: James G. McElroy, 115 Mesa Ct., Conroe, Tex. 77302

[21] Appl. No.: 336,844

[22] Filed: Jan. 4, 1982

[51] Int. Cl.[3] ..... F27B 9/00; F27B 9/28; C21D 9/54

[52] U.S. Cl. ..... 432/149; 266/103; 432/59; 432/148

[58] Field of Search ..... 266/103; 432/8, 59, 432/148, 149

[56] References Cited

U.S. PATENT DOCUMENTS

| | | | |
|---|---|---|---|
| 1,946,971 | 2/1934 | Harter | 432/133 |
| 3,721,517 | 3/1973 | Osthoff | 432/8 |
| 4,125,364 | 11/1978 | Stephens | 432/149 |
| 4,309,165 | 1/1982 | McElroy | 431/8 |

*Primary Examiner*—John J. Camby

*Attorney, Agent, or Firm*—Murray Robinson; Ned L. Conley

[57] ABSTRACT

The combustion system includes a hearth lined with refractory, a combustion chamber formed in the refractory, an air manifold mounted on the hearth, a plurality of gas manifolds extending through the air manifold and into the combustion chamber, and a diffuser mounted on the manifolds to cause turbulence in the air/gas mixture. The gas manifolds include aspirating means for combining the air and gas. The combustion chamber is elongated and has an elongated neck with a flue gas exit slot over which the work piece passes. The flue gas from the combustion of the air/gas mixture in the combustion chamber increases in velocity as the flue gas passes through the elongated neck and exits the flue gas exit slot. The slot has a length sufficient to permit the work piece to rotate 360° as the work piece rotates and travels through the hearth. This causes the work piece to be uniformly heated over every square inch of its surface.

10 Claims, 4 Drawing Figures

COMBUSTION FURNACE AND BURNER

REFERENCE TO RELATED APPLICATION

Applicant claims the priority of co-pending U.S. Pat. No. 4,309,165 issued Jan. 5, 1982, entitled "High Velocity Combustion Furnace and Burner."

BACKGROUND OF THE INVENTION

This invention pertains to fuel combustion furnaces, and more particularly to normalizing furnaces suitable for use with high pressure combustion air and high velocity flue gas.

The normalizing furnaces of the prior art rely primarily on radiant heating and only secondarily upon forced convection. Since the rate of heat transfer by radiation is fixed, the heat transfer per time is also limited in such prior art furnaces. Where prior art furnaces operate at low pressures and velocities, the heat treat time for a given work piece is extended thereby substantially increasing fuel consumption.

Prior art burners are extremely complex and have many parts. Also, a large pressure drop occurs between the air blower and burner. Such a pressure drop is necessary in prior art burners to permit adequate control. The burners of the prior art are not able to achieve the small combustion chamber space and air/gas mixture of pre-mix systems.

Many high velocity burners operate with excess air and therefore require an auxiliary air source not regulated by the regulator for the air/gas mixture whereby as the air/gas mixture is turned down, such burners become oxidizing and therefore an excess air burner.

Most prior art systems have relatively low combustion chamber pressures as compared to the present invention. The burner of the present invention operates at increased air pressure to permit combustion chamber pressures of approximately 8 to 10 times greater than that generally achieved by the prior art.

Further, in prior art furnaces using high velocity burners, the combustion chambers have round exit ports which prevent the entire surface area of the work piece from being exposed to the hot flue gases. The hot flue gases leaving the exit ports tend to heat the work piece in a "ribbon" manner, i.e., that portion of the work piece exposed to the exit ports as the work piece rotates and travels through the hearth. This prevents uniform heating of the work piece.

The present invention overcomes these defects in the prior art. Other objects and advantages of the invention will appear from the following description.

SUMMARY OF THE INVENTION

In accordance with the teachings of the invention, the normalizing furnace includes a hearth, a combustion chamber, burners, and an air/fuel control system. The control system controls a pressurized air supply, a regulated gas supply, and means for regulating the gas supply as a function of the air pressure. The burner includes an air manifold, a refractory section, and a gas pipe extending from the exterior of the air manifold through the refractory section and into the combustion chamber. The gas pipe includes gas control orifices adjacent a diffuser mounted on that end of the gas pipe extending into the combustion chamber. The diffuser mixes the air and gas and causes turbulence in the air/gas mixture.

Regulated air and gas are supplied to the air manifold and gas pipe respectively. The pressurized air passes through the air manifold and an annular area around the gas pipe created by the gas pipe extending through an aperture in the refractory section adjacent the air manifold whereby the gas control orifices create a low pressure area around the outside of the gas pipe. The gas passes from the high pressure area to the low pressure area through the gas control orifices in the gas pipe. There the gas mixes with the air and passes against the diffuser creating turbulent flow where the air/gas mixture is ignited in the combustion chamber. The combustion chamber has an enlarged portion to permit the expansion of the air/gas mixture for combustion and a reduced portion for increasing the velocity of the flue gas exiting the combustion chamber. The velocity of the flue gas causes a back pressure within the combustion chamber. The high velocity flue gas passing around the work piece in the hearth heats the work piece primarily by forced convection. The outlet of the reduced portion is elongated and has a length which permits the work piece to rotate 360° as the work piece twists through the hearth. This causes the work piece to be uniformly heated over all of its surface area.

BRIEF DESCRIPTION OF THE DRAWINGS

For a detailed description of the preferred embodiment of the invention, reference will now be made to the accompanying drawings wherein.

DESCRIPTION OF THE PREFERRED EMBODIMENT

The present invention is a normalizing furnace and also may become a quench furnace by operating a quench after the furnace. The preferred embodiment disclosed in U.S. Pat. No. 4,309,165 is a forge furnace for heating the ends of pipe. The disclosure of U.S. Pat. No. 4,309,165, issued Jan. 5, 1982, and entitled "High Velocity Furnace and Burner" is incorporated herein as though fully set forth in its entirety in the present application.

Figure 1:
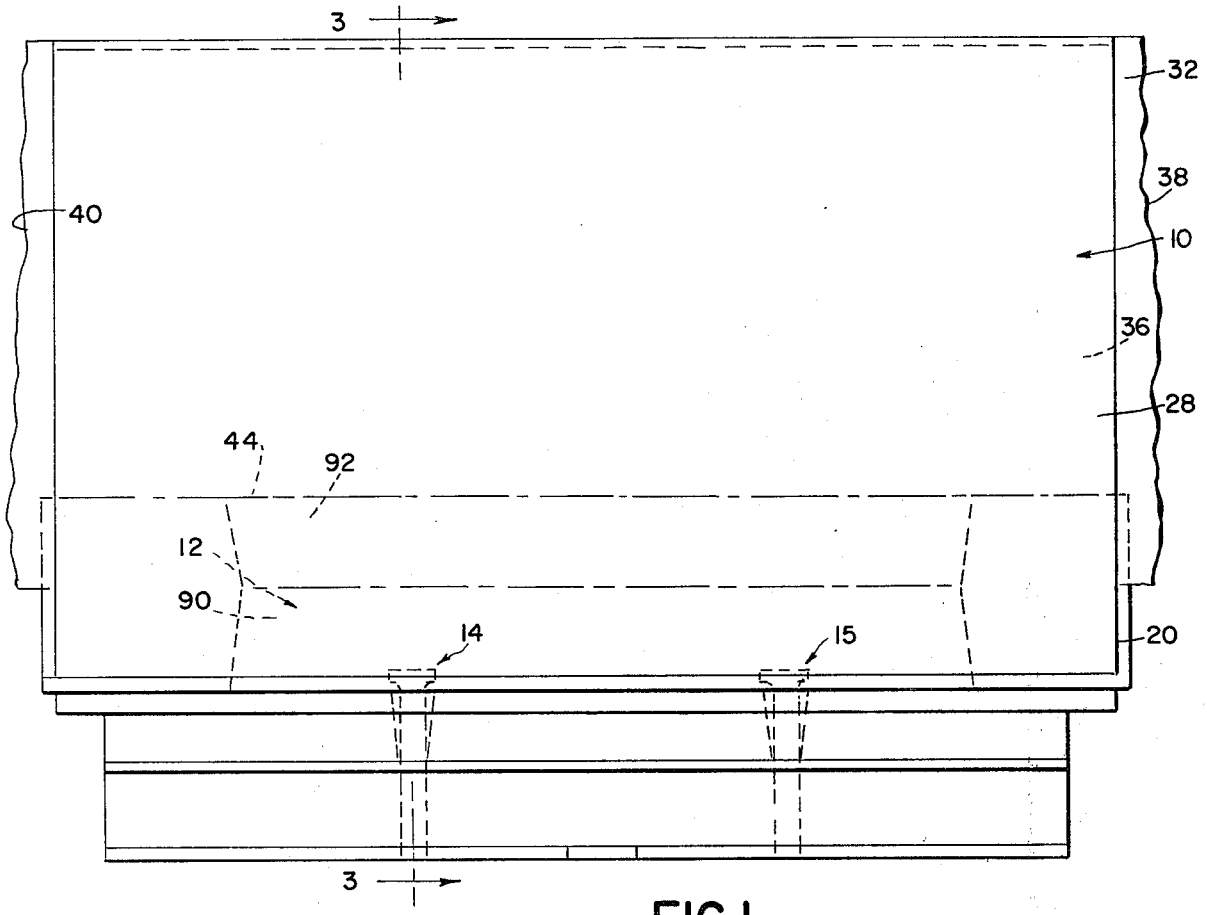
FIG. 1 is a side elevation of the furnace.
Figure 2:
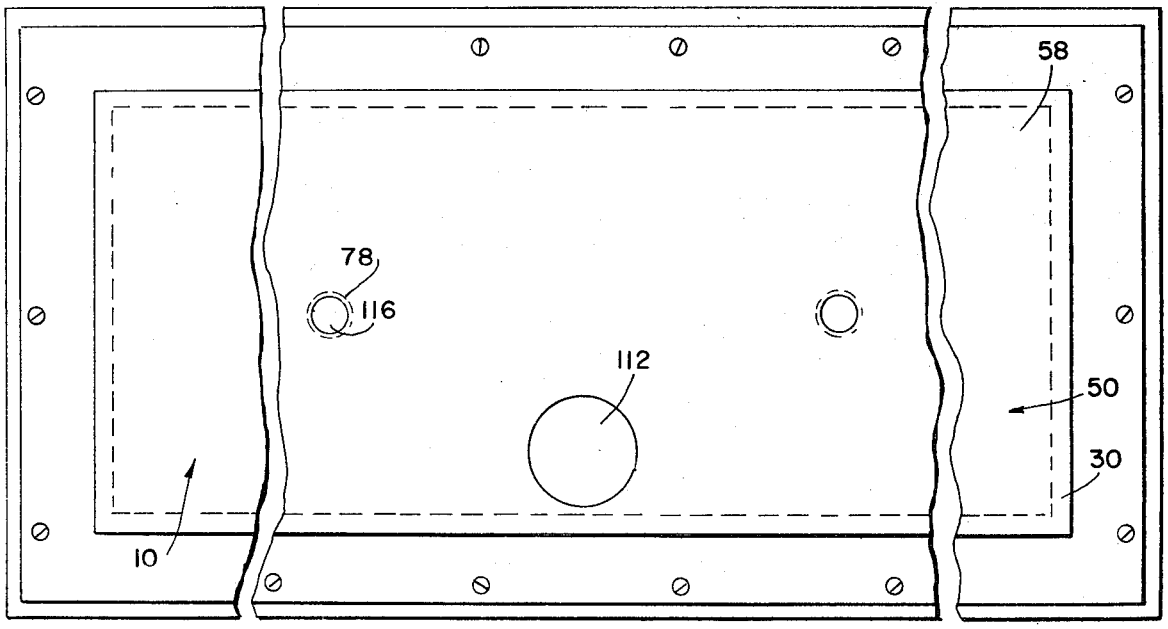
FIG. 2 is a bottom view of the furnace shown in FIG. 1.
Figure 3:
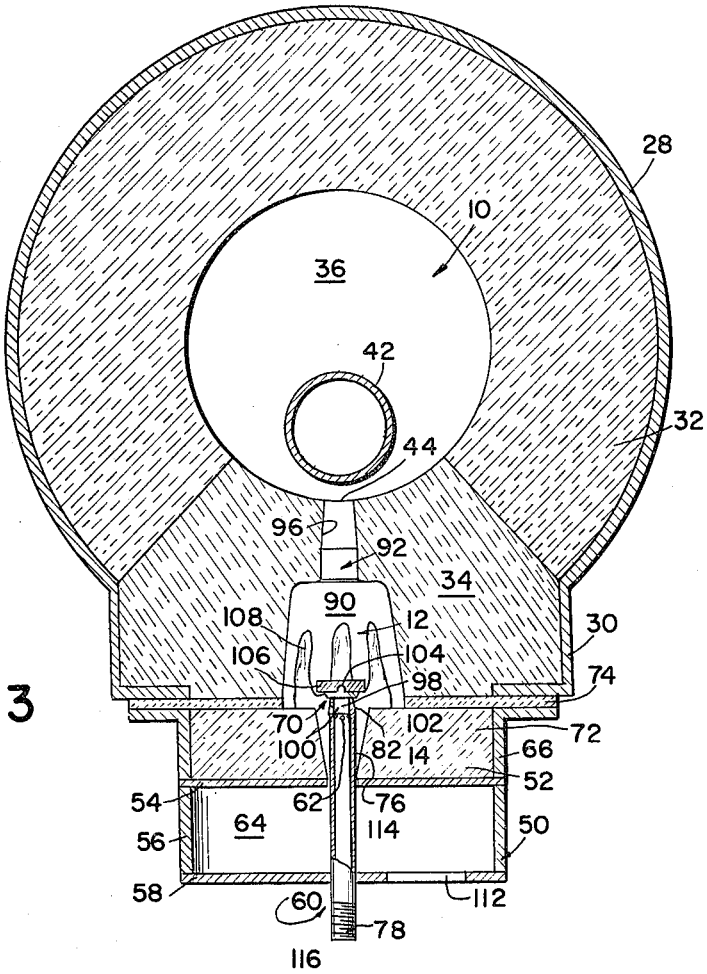
FIG. 3 is a section view taken along the line 3—3 in FIG. 1.

The normalizing furnace of the present invention includes 18 different modules, a typical one of which is disclosed in FIGS. 1–3, through which pipe 42 is run lengthwise for heat treat. The line of 18 modules is approximately 72 feet long from inlet to exit. There are rollers between each of the modules to rotate and propel the pipe through the normalizing furnace. The rollers are cambered approximately 22½° to twist the pipe 42 as it travels through the furnace. The rollers of the preferred embodiment are on a 4 foot center line. However, the center line of the rollers will vary depending upon the length of the pipe passed through the normalizing furnace. For example, if 1-inch pipe is run through the normalizing furnace, the rollers must not be located over 4 feet apart since the end of 1-inch pipe will hit the furnace before it engages the next roller down the line. If, however, 3½ inch pipe is run through the normalizing furnace, the rollers could be 6 feet apart. The spacing of the rollers depends upon the thickness of the wall of the pipe, since smaller diameter pipe will sag over a shorter span. The speed of the pipe through the normalizing furnace depends upon the wall thickness and the weight of the pipe. In the preferred embodiment, pipe can be run from as low as 10 feet per minute to as high as 50 feet per minute, depending upon the wall thickness and the weight of the pipe.

Figure 4:
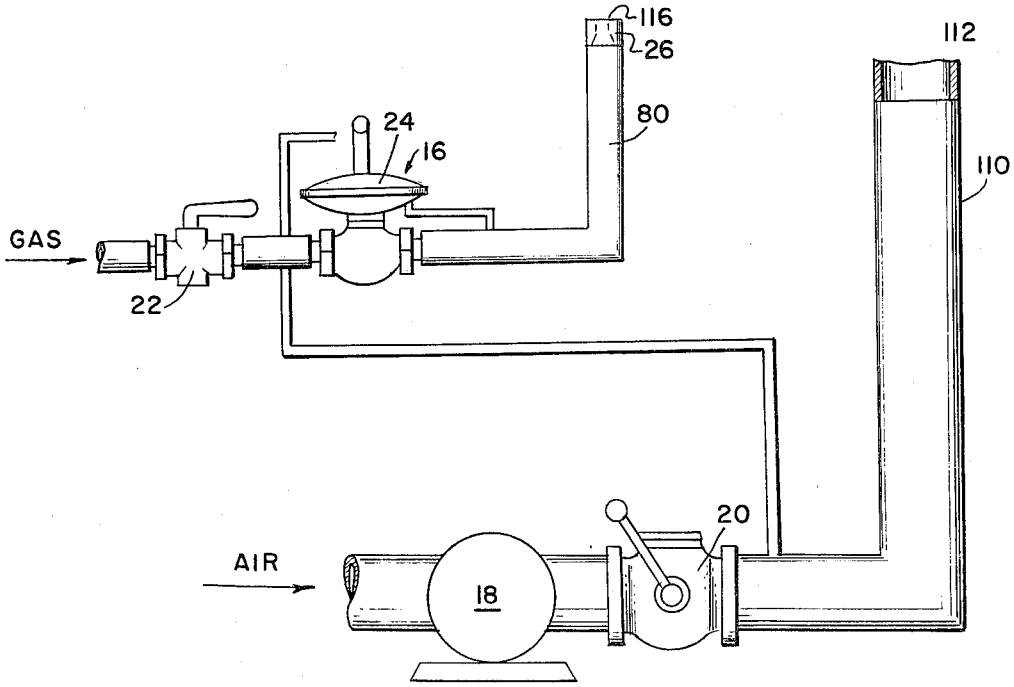
FIG. 4 is a schematic of the control system for the furnace shown in FIGS. 1–3.

One module of the normalizing furnace of the present invention shown in the figures includes a furnace hearth 10, a combustion chamber 12, a plurality of burners 14, 15, and an air/fuel control system 16. Referring initially to FIG. 4, the control system 16 generally includes an air supply (not shown), an air blower 18, an air valve 20, air line 110, a fuel supply (not shown), a fuel cut off valve 22, a regulator 24, gas line 80, and a limiting orifice 26. The control system 16 may be electrically controlled or motorized and may control the supply of air and fuel for the burners of all the modules in the system. The control system 16 is so designed that control of the air pressure will automatically control the gas pressure after proper adjustment. For a detailed description of the operation of control system 16, reference should be made to co-pending application, U.S. Pat. No. 4,309,165.

Referring now to FIGS. 1-3, hearth 10 of one module includes a generally cylindrical housing 28 mounted on a rectangular base 30. Cylindrical housing 28 is lined with an insulating blanket 32 and by a portion of the refractory 34 which also forms combustion chamber 12. A cylindrical passageway 36, concentric within cylindrical housing 28, extends longitudinally through the module having an open inlet end 38 and an open exit end 40 through which a work piece 42 may pass. The normalizing furnace shown has been designed for pipe, such as work piece 42, which is fed through hearth 10 by automated rollers which rotate and propel pipe 42 through hearth 10. A longitudinal slot 44 extends much of the length of passageway 36 to communicate with each of the burners, such as burners 14 and 15. As the pipe 42 travels and rotates over slot 44, it is heat treated. Insulating blanket 32 may be made from Cerachrome flue liners manufactured by Johns-Manville. The insulating blanket is made with a quarter section left out which is supplied by refractory 34 forming combustion chamber 12. Insulating blanket 32 is slipped into housing 28 to form hearth 10.

Combustion chamber 12 includes an enlarged channel-like portion 90 with an elongated neck-like portion 92. Channel portion 90 and neck portion 92 extend substantially the length of hearth 10 as shown in FIG. 1, and communicate with all burners such as 14 and 15. The upper open end of neck portion 92 forms longitudinal flue gas exit slot 44 over which pipe 42 passes for heat treat. Although not necessary, slot 44 is the narrowest part of neck portion 92. The upper part 96 of neck portion 92 is narrowed to increase the velocity of the flue gas as it passes through neck portion 92 and exits slot 44. Combustion chamber 12 is molded by injecting refractory 34 into a mold and ram packing the refractory into the mold. Refractory 34 is preferably Jade-Pak 88 manufactured by A. P. Green. As previously discussed, refractory 34 serves as the bottom quarter portion of hearth 10 to form passageway 36. Refractory 34 is housed within hearth base 30.

The cubic volume of space required for combustion chamber 12 is reduced since the present invention is operated with a back pressure, and thus, only a very small space is required for a maximum intense flame, thereby permitting refractory 34 to be close to work-piece 42, shortening the heat treat time, and increasing the number of available BTU's for work piece 42.

Referring now to FIG. 3, a typical burner 14 includes an air manifold 50, a gas manifold or pipe 60, aspirating means or gas control orifices 62 in gas pipe 60, a diffuser or baffle 70, and a refractory section 52. Air manifold 50 is rectangularly shaped and houses a plurality of gas pipes, such as gas pipe 60. An upper cover plate 54, rectangular sides 56, and a bottom cover plate 58 form air manifold 50 and air chamber 64. Bottom plate 58 includes apertures for gas line 80 and air line 110 at 116, 112 respectively. Upper cover plate 54 serves both as a cover for the top of air manifold 50 and a bottom for refractory section 52. Refractory section 52 is also rectangularly shaped to conform with air manifold 50, and includes rectangular sides 66. Refractory section 52 is packed with refractory 72 and is preferably Jade-Pak 88 manufactured by A. P. Green. Aperature 76 is tubular from plate 54 into the lower portion of refractory 72 and then flares approximately 5° into a conical shape in refractory 72. A gasket 74 is provided between refractory 72 and refractory 34. Gasket 74 is required because refractory 34 and/or refractory 72 may have a hole in it when it gets hard which would permit gas to escape through the refractory and burn up plate 54. Gasket 74 also seals between the two refractories.

Gas pipe 30 is threaded at 78 for threaded connection at 116 to gas pipe 80 shown in FIG. 4. The other end 82 of gas pipe 30 has a 10° taper flaring upward from the tip of pipe 30 to a point just past gas control orifices 62. Gas pipe 30 extends through aperture 76 to form annular chamber 114.

Aspirating means or gas control orifices 62 include gas outlet ports azimuthally spaced around the periphery of gas pipe 30. Although there may be any number of ports, there are preferably eight. Gas control orifices 62 are sized in relation to neck portion 92 and are sized to provide ample flow of gas out into the air flowing through annular chamber 114.

The air and gas from supply lines 110, 80 respectively, enter at ambient and are subsequently elevated to a temperature of between 2,900° and 3,000° F. upon combustion at diffuser 70. With such an elevation in temperature, it is necessary that the gas be permitted to expand in combustion chamber 12 since at any given pressure, one can only burn so much air/gas mixture in a given cubic volume of area in a combustion chamber. Thus, the cross-sectional area of the narrowest part of neck portion 92 must be at least 8 times greater than the cross-sectional area of annular area 114 of air manifold 50. Channel portion 90 of combustion chamber 12 permits the gas to expand approximately 7 times to achieve sufficient volume to permit combustion. The resulting flue gas from combustion is then choked down by neck portion 92 to increase the velocity of the exiting flue gas and to create a back pressure on burner 14. This choking effect creates a substantial velocity of the exiting flue gas to permit forced convection heating of work piece 42. The temperature of the refractory around neck portion 92 will be 3000°+ F. for the preferred embodiment.

It is important to have the gas control orifices 62 large enough to permit free flow of the flue gas out of slot 44 in neck portion 92. Although the area of gas outlet ports of gas control orifices 62 must have some minimum size to assure the exiting of the flue gas, the flow of the gas through the system may be regulated by limiting orifice 26 or by a limiting orifice needle valve (not shown) to prevent the sizing of gas control orifices 62 from becoming critical.

Gas pipe 30, air/gas control orifices 62, and air manifold 50 are all airtight to prevent any mixture of the gas with the combustion air prior to mixing adjacent diffuser 70. By preventing any premature mixture of the gas with air, there can be no explosion, backfire, or burn back since there is no oxygen for the gas to burn.

Diffuser 70 includes a plug 98 having a rodlike end 100 adapted to be received into the tapered end 82 of gas pipe 30, a transition radius portion 102, and a hub 104 for the mounting of a diffuser ring 106. Plug 98 is received in end 82 of gas pipe 30 and is welded thereto. Diffuser ring 106 has a bore which receives hub 104 and is welded to plug 98. Transition radius portion 102 has a smaller diameter equal to the outside diameter of tapered end 82 of gas pipe 30 and a larger diameter equal to the outside diameter of gas pipe 30. Gas pipe 30 has sufficient length to extend from outside of air manifold plate 58 through air chamber 64 and refractory section 52 so as to permit diffuser ring 106 to be housed in combustion chamber 12.

To achieve maximum efficiency of burner 14, the air/gas mixure is placed in turbulent flow around diffuser 70. Such turbulence enhances the mixture of the gas and air and is created by the air and gas trying to rush back into the middle of the ports of gas control orifices 62 to fill voids. Diffuser 70 maintains pressure on the gas/air mixture for a short distance after the air/gas mixture passes gas control orifices 62.

Flame 108 is ignited at diffuser ring 106 and engulfs channel portion 90 of combustion chamber 12. The burning of the air/gas mixture by flame 108 creates the flue gas. In the embodiment shown, the air and gas have a pressure of 2 psi creating a flue gas velocity through neck 92 of approximately 500 feet per second. This velocity of the flue gas creates a back pressure in channel portion 90 of approximately 8 inches water column.

Air blower 18 pressurizes the air to approximately 2 psi. Since the velocity of gas flow through gas control orifices 62 is directly proportional to the pressure on the gas caused by the aspiration effect of aspiration means or gas control orifices 62, a change in air pressure will cause a corresponding change in the gas pressure for mixing purposes in burner 14. Since the velocity is directly proportional to the air pressure in air manifold 50, it is only necessary to control the air pressure to also adjust flue gas velocity and the pressure in combustion chamber 12. As discussed previously, with gas being a slave to the air, the air pressure will also control the gas pressure. Thus, the furnace system is completely responsive to the air pressure placed on the system by blower 18. Thus, control system 16 sets the ratio of gas to air in burner 14 so that the burner may run lean, stoichiometric, or rich.

With a back pressure in channel portion 90 of combustion chamber 12, a 2 psi air pressure will cause the flue gas to have a velocity of 500 feet per second through neck portion 92. The invention obtains an especially good mixture of gas with air using diffuser 70, increased turbulence with diffuser 70, back pressure, and high velocities, to permit burner 14 to provide heat of approximately 3500° F. due to increased air pressure which achieves flue gas velocities in excess of 200 feet per second. The use of the air enslaving the gas keeps the flame on the combustion side of plate 54 and prevents plate 54 from overheating.

Flashbacks are prevented by mixing the air and gas near diffuser 70. If the back pressure is so great that the gas cannot flow through gas control orifices 62, the aspiration effect by aspiration means 62 will cease and the gas will no longer become entrained in the air. Since there is no longer any gas, the flame will go out and the burner will not operate. Thus, the flame cannot be cut to zero without putting the flame out since there would no longer be any air or gas flow.

Although back pressure does not aid in the rate of heat transfer to a work piece, it does level out the heat within combustion chamber 12 and hearth 10 and prevent cold spots. A cold spot is caused by a decrease in pressure due to a decrease in the volume of flue gas. By increasing the air pressure to approximately 2 psi, there is sufficient pressure to force the hot flue gas into these cold spot areas. Further, an increase in the flue gas velocity due to an increase in air pressure will increase the turbulence within gas control orifices 62 which assists in the efficiency of the burner.

In operation, combustion air is passed from air line 110, shown in FIG. 4, into chamber 64 at inlet 112 and impinges on plate 54 where heat is transferred to the air. The pressure of the preheated air forces the air into aperture 76 around gas pipe 30. Natural gas is supplied to burner 14 by gas line 80 connected at 116 to gas pipe 30. The gas flows into gas pipe 30 where it is preheated by heat transfer from gas pipe 30 by conduction. The gas flows through gas control orifices 62 into the stream of air passing through annular passageway 114 formed by gas pipe 30 within aperture 76. Diffuser 70 creates turbulence in the air and gas causing the gas to become entrained into the air and a slave to the air as the air passes through aperture 76 and past diffuser 70 formed by tapered gas pipe end 82, transition portion 82 of plug 98, and diffuser ring 106. Further, these create turbulence in the air/gas mixture and cause the mixture to leave the burner in a fan-shaped pattern where it is burned by flame 108. After the flue gas passes through neck portion 92 of combustion chamber 12 and into hearth 10, the expanded volume at hearth 10 reduces the flue gas velocity around the inner surface of hearth 10 to approximately 50 to 100 feet per second. This reduction in velocity lengthens the life of insulating blanket 32.

The flue gas heats pipe 50 by forced convection. The flue gases also heat refractory 34 which in turn heats pipe 50 by radiation. Thus, pipe 50 is heated primarily by forced convection and secondarily by radiation.

Pipe 50 passes lengthwise through the series of modules a distance of 72 feet. The pipes, such as pipe 50, are rolled through the modules lengthwise by the roller conveyor (not shown) so that the lengths of pipe are subjected to the flue gas passing through slot 44 from the burners, such as burners 14 and 15 in the module shown.

The length of longitudinal slot 44 is sized with the travel of the pipe 42 so that the pipe 42 makes a 360° rotation between the start and end of slot 44. Thus, every square inch of the surface area of pipe 42 is exposed to the high velocity flue gases exiting slot 44. The pipe 42 is completed bathed. Because the back pressure in combustion chamber 12 evens out the heat and velocity through neck portion 92, pipe 42 is uniformly heated as it travels through the furnace.

The present invention includes a system using high flue gas velocity, high combustion air pressure, turbulence, back-pressuring, and primary forced convection heating, using radiant heating only secondarily, to provide a system much more efficient than that of the prior art.

Changes and modifications may be made in the specific illustrated embodiment of the invention shown and/or described herein without departing from the scope of the invention as defined in the appended claims.

I claim:

1. A combustion system for burning air and gas, comprising:

an air manifold for receiving air;

a gas manifold for receiving the gas, said gas manifold being disposed within said air manifold;

aspirating means for combining the gas from said gas manifold with the air from said air manifold to create an air/gas mixture;

diffuser means for creating turbulent flow of the air/-gas mixture;

said aspirating means being juxtaposed to said diffuser means; and a combustion chamber having an enlarged portion housing said diffuser means and a reduced portion communicating said enlarged portion with a hearth.

2. A combustion system as defined in claim 1 wherein said aspirating means includes ports through said gas manifold whereby an aspirating effect is created by the air flow across said ports causing the gas to flow from said gas manifold.

3. A combustion system as defined in claim 1 wherein said diffuser means includes a baffle restricting the flow of the air/gas mixture.

4. A combustion system as defined in claim 1 and further including means for placing the air under pressure prior to entering said air manifold, said air pressure being sufficient to create a flue gas velocity through said reduced portion to cause a back pressure within said enlarged portion whereby a work piece is primarily heated by forced convection.

5. The combustion system as defined in claim 1 and further including an aperture around said gas manifold extending from said air manifold to said combustion chamber whereby the air passes over said gas manifold and aspirating means.

6. The combustion system as defined in claim 1 wherein said enlarged portion and reduced portion are elongated with said reduced portion forming an elongated flue exit slot whereby the flue gas increases in velocity through said reduced portion and exits through said slot onto a work piece.

7. The combustion system as defined in claim 6 wherein said elongated slot has a length permitting the work piece to rotate 360° as the work piece rotates and travels over said slot.

8. A combustion system for burning air and gas thereby creating a flue gas for heating a work piece rotated and passed through the combustion system, comprising:

a hearth lined with refractory;

an elongated combustion chamber formed in said refractory, said chamber having an elongated neck forming a flue gas exit slot into said hearth over which the work piece passes;

an air manifold for receiving the air and mounted on said hearth with an insulator disposed therebetween;

a plurality of gas manifolds for receiving the gas;

a plurality of apertures extending from said air manifold through said insulator and communicating with said combustion chamber, each of said gas manifolds extending through one of said apertures to form an annular chamber for the passage of air from said air manifold to said combustion chamber;

each of said gas manifolds having aspirating means for combining the gas from said gas manifolds with the air flowing through each of said annular chambers from said air manifold to create an air/gas mixture; and diffuser means on said gas manifolds for creating a turbulent flow of the air/gas mixture, said aspirating means being juxtaposed to said diffuser means whereby the combustion of said air/gas mixture in said combustion chamber forms the flue gas which increases in velocity as the flue flows through said elongated neck and exits said flue gas exit slot onto the work piece to heat the work piece by forced convection.

9. The combustion system as defined by claim 8 wherein said elongated slot has a length permitting the work piece to rotate 360° as the work piece rotates and travels over said slot whereby every square inch of the work piece is bathed by the flue gas exiting said combustion chamber.

10. The combustion system as defined by claim 8 further including a gasket disposed between said refractory and said insulator.

* * * * *